United States Patent [19]

Emerson

[11] Patent Number: 4,549,585

[45] Date of Patent: Oct. 29, 1985

[54] SELF MIXING FUNNEL

[76] Inventor: Hartley T. Emerson, 1509 11th St. South, Virginia, Minn. 55792

[21] Appl. No.: 567,049

[22] Filed: Dec. 30, 1983

[51] Int. Cl.[4] ..... B67C 11/06

[52] U.S. Cl. ..... 141/95; 141/105; 366/336

[58] Field of Search ..... 141/9, 69, 94, 95, 198, 141/331, 336, 344, 345, 105; 222/133; 366/142, 150, 151, 178, 181, 183, 336, 337

[56] References Cited

U.S. PATENT DOCUMENTS

| | | | |
|---|---|---|---|
| 454,240 | 6/1891 | Whelan | 141/95 |
| 1,429,574 | 9/1922 | England et al. | 366/336 X |
| 1,654,172 | 12/1927 | Johnson | 141/94 |
| 1,946,473 | 2/1934 | Babendreer et al. | 222/133 |
| 2,902,062 | 9/1959 | Smekal | 141/105 |
| 2,986,162 | 5/1961 | Spexarth | 137/571 |
| 3,055,554 | 9/1962 | Wight | 22/133 |
| 4,125,334 | 11/1978 | Jones | 141/9 X |
| 4,140,160 | 2/1979 | Glackin | 141/332 |

*Primary Examiner*—Stephen Marcus
*Assistant Examiner*—Mark Thronson
*Attorney, Agent, or Firm*—Peterson, Wicks, Nemer & Kamrath

[57] ABSTRACT

A self mixing funnel according to the teachings of the present invention is shown as including an outer funnel portion and an oil retainer. The oil retainer is suspended within the outer funnel portion with its filling open end below the filling open end of the funnel portion. Oil may then be placed in the oil retainer and gasoline can be poured into the oil retainer for mixing with the oil and overflowing the filling open end of the oil retainer into the outer funnel portion for discharge therethrough. In its most preferred form, the oil retainer further includes a discharge open end having a releasably sealing stopper. An elongated rod is further provided attached to the stopper and including a float and an enlarged member. The float floats on the mixed liquid in the collection container for removing the stopper from the discharge open end of the oil retainer when a predetermined level is reached. The enlarged member allows manual raising of the stopper from the discharge open end of the oil retainer and for visually indicating when the level in the collection container reaches the predetermined level.

14 Claims, 3 Drawing Figures

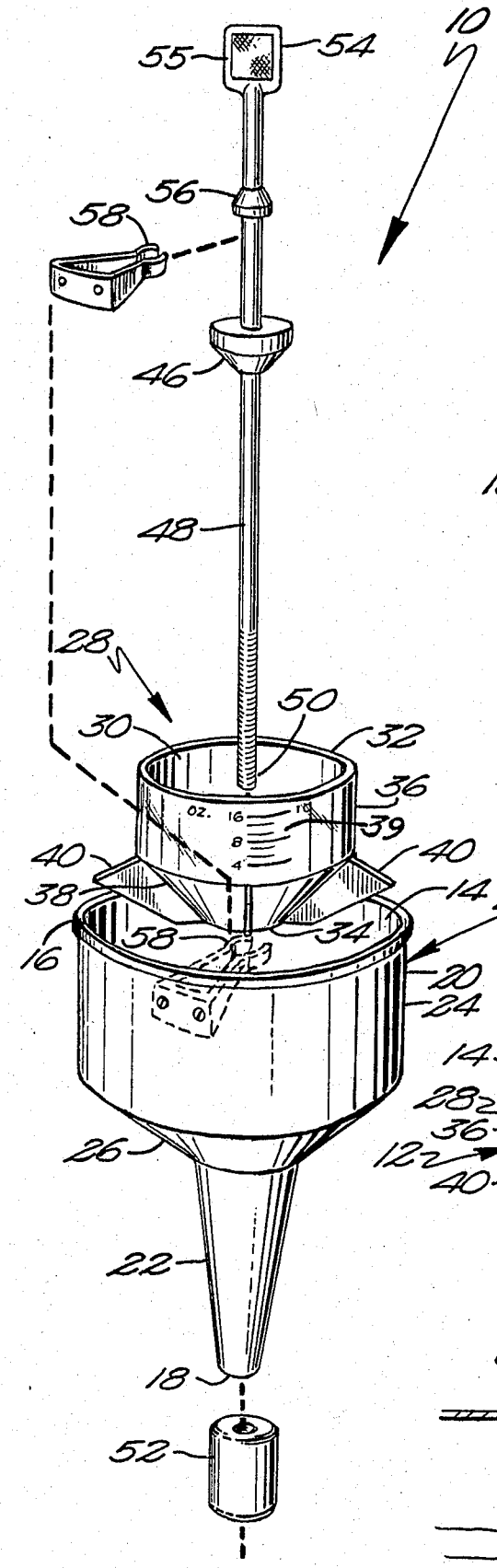
FIG 1
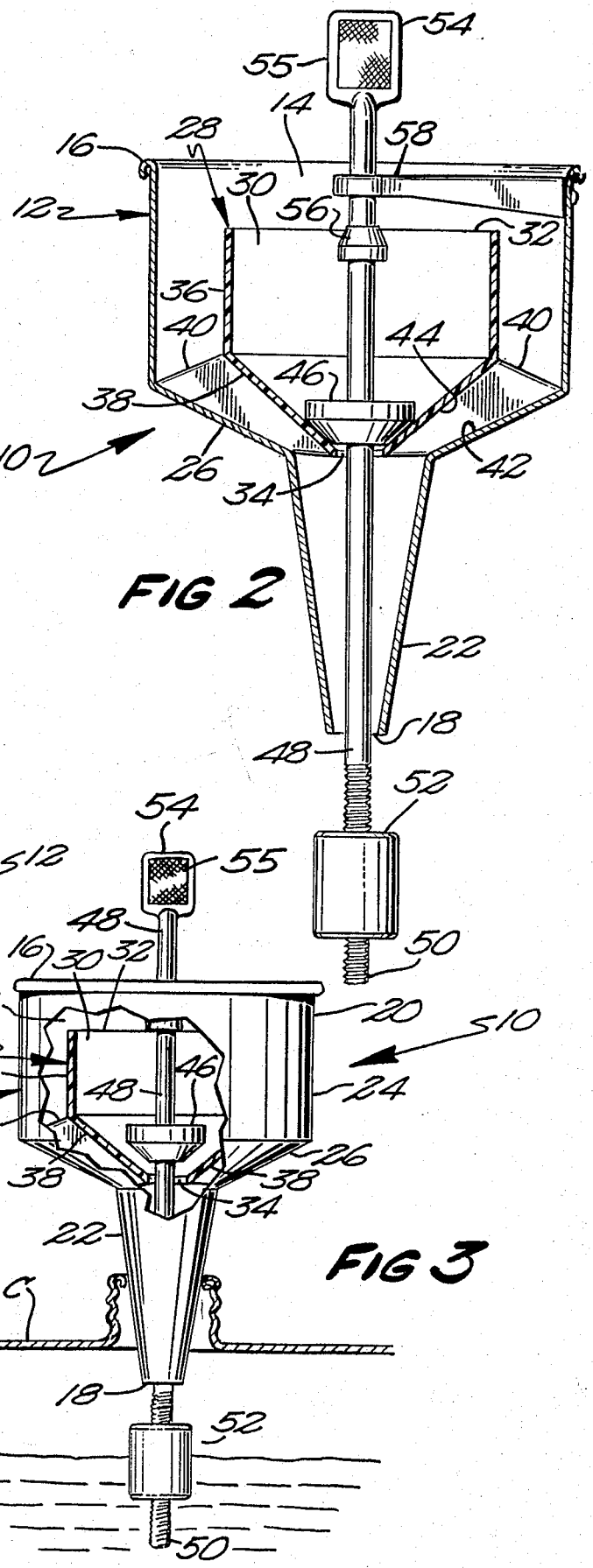
FIG 2
FIG 3

SELF MIXING FUNNEL

BACKGROUND

The present invention relates generally to funnels and more specifically to self mixing funnels.

For many applications, it is necessary to mix liquids such as oil and gasoline. Such mixtures of oil and gasoline are required for use in many two-cycle engines such as utilized in chain saws, snowmobiles, and the like. Prior to the present invention, oil was often mixed with gasoline by dumping the oil and gasoline into a container and then by shaking the container. However, for various factors including the weight of the container with the gasoline and oil therein, such a procedure often did not result in a thorough mixing of the oil and gasoline. Further, prior attempts to provide structures for mixing gasoline with oil have proved to be similarly deficient in not thoroughly mixing oil, by not providing ease of operation, and like reasons. Thus, a need has arisen for a self mixing funnel which overcomes these many deficiencies.

SUMMARY

The present invention solves these and other problems in mixing a first liquid with a second liquid by providing a self mixing funnel utilizing a spill over effect. Specifically, the self mixing funnel of the present invention includes an outer funnel portion and a liquid retainer having a shape and size allowing its placement within the interior of the outer funnel portion. The liquid retainer is suspended within the interior of the outer funnel portion with the level of the filling open end of the liquid retainer being below the level of the filling open end of the funnel portion. The first liquid can then be poured and retained within the interior of the liquid retainer. The second liquid can then be poured into the interior of the liquid retainer for mixing with the first liquid and spilling over the filling open end of the liquid retainer into the interior of the funnel portion for discharge through the discharge open end of the funnel portion.

Thus, it is an object of the present invention to provide a novel self mixing funnel.

It is also an object of this invention to provide such a novel self mixing funnel which utilizes a spill over effect.

It is also an object of this invention to provide such a novel self mixing funnel which thoroughly mixes a first liquid with a second liquid.

It is also an object of this invention to provide such a novel self mixing funnel which allows mixing to be terminated or resumed at the operator's discretion.

It is also an object of this invention to provide such a novel self mixing funnel which provides ease of operation, safety, and mixture control.

It is also an object of this invention to provide such a novel self mixing funnel which can be easily manufactured from inexpensive material.

It is also an object of this invention to provide such a novel self mixing funnel which can be removed from the collection tank container at any time with no resulting spillage.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where:

FIG. 1 shows an exploded, perspective view of a self mixing funnel constructed according to the teachings of the present invention.

FIG. 2 shows a full sectional view of the self mixing funnel of FIG. 1 taken along section line 2—2 of FIG. 1 and viewed as though fully assembled.

FIG. 3 shows a partial sectional view of the self mixing funnel of FIG. 1 in use.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms, "top", "bottom", "first", "second", "inside", "outside", and similar terms are used herein, it should be understood that these terms have reference only to the structure shown in the drawings as it would appear to a person viewing the drawings and are utilized only to facilitate describing the invention.

DESCRIPTION

A self mixing funnel according to the teachings of the present invention is shown in its preferred form in the drawings and generally designated 10. Funnel 10 generally includes an outer funnel portion 12. Generally, funnel portion 12 includes an interior 14, an enlarged, filling open end 16, and a reduced, discharge open end 18. In the preferred form, funnel portion 12 includes an enlarged upper portion 20 and a discharge tube 22. Discharge tube 22 includes open end 18 and has an elongated, frusto-conical shape in its preferred form. Upper portion 20 includes a cylindrical shaped member 24 having open end 16 and includes a frusto-conical member 26 in its most preferred form. It should then be noted that funnel portion 12 can have a variety of shapes and constructions other than as shown and described according to the teachings of the present invention.

Funnel 10 further includes an oil retainer 28 located within interior 14 of funnel portion 12. Generally, oil retainer 28 includes an interior 30, and an enlarged, filling open end 32, and a reduced, discharge open end 34. Open end 32 of oil retainer 28 has a size considerably smaller than open end 16 of funnel portion 12. In the preferred form, oil retainer 28 includes a cylindrical shaped member 36 having open end 32 and a frusto-conical shaped member 38 having open end 34. In the preferred embodment, oil retainer 28 includes members 39 shown in their most preferred forms as graduation marks for visually determining the amount of liquid in retainer 28. It should then be noted that oil retainer 28 can have a variety of shapes and constructions other than as shown and described according to the teachings of the present invention.

Funnel 10 further includes members 40 for suspending oil retainer 28 within interior 14 of outer funnel portion 12. In their most preferred form, members 40 are webs extending between the interior surface 42 of funnel portion 12 and the outside surface 44 of oil retainer 28. In its most preferred form, oil retainer 28 is located in interior 14 concentrically with funnel portion 12. Oil retainer 28 is suspended within funnel portion 12 by webs 40 such that open end 32 of oil retainer 28 is below the level of open end 16 of funnel portion 12.

In the preferred embodiment, funnel 10 further includes a sealing member 46 shown in its most preferred form as a stopper for sealing open end 34 of oil retainer 28. Additionally, funnel 10 includes in its most preferred form an elongated rod 48 upon which stopper 46 is mounted. Rod 48 extends through open ends 16 and 18 of funnel portion 12 and through open ends 32 and 34 of oil retainer 28 in the preferred embodiment. In its most preferred form, the first end 50 of rod 48 extending through open end 18 of funnel portion 12 includes a float 52 mounted thereto. In the preferred embodiment, float 52 has a threaded securement to rod 48 to allow manual adjustment of float 52 on rod 48 by simply turning float 52 thereon. The second end 54 of rod 48 extending through open end 16 of funnel portion 12 includes an enlarged portion 55. Intermediate end 54 and stopper 46, rod 48 further includes in the preferred embodiment a retaining member 56 for interacting with a hanger member 58 shown in its most preferred form as first and second spring, leaf arms for releasably engaging with and holding retaining member 56.

Now that the construction of a self mixing funnel 10 according to the teachings of the preferred embodiment of the present invention has been set forth, the operation and subtle features of the present invention can also be set forth and appreciated. Specifically, funnel 10 can be positioned within a collection container C such that discharge tube 22 of outer funnel portion 12 extends within the opening of container C with outer funnel portion 12 resting upon and being supported by the collection container. It is realized it may be necessary to further support funnel 10 such as manually or that other means of support can be provided.

With discharge tube 22 extending within container C, float 52 is located within collection container C. Stopper 46 then may be positioned within open end 34 of oil retainer 28. At that time, a first liquid such as oil may be poured into interior 30 of oil retainer 28. It can then be appreciated that graduation marks 39 facilitate the operator in accurately measuring the amount of liquid poured into oil retainer 28 for providing the proper mixing ratio according to the size of collection container C. At that time, a second liquid such as gasoline may also be poured within interior 30 of oil retainer 28. The gasoline will then mix with the oil in oil retainer 28 and the resulting mixture will overflow open end 32 of oil retainer 28 and flow within interior 14 of outer funnel portion 12 for discharge through open end 18 of discharge tube 22.

It can then be realized that a thorough mixing of the oil and gasoline is accomplished as a result of the spill over effect provided by the present invention. Furthermore, it can be appreciated that mixing can be terminated or resumed at the operator's discretion by simply directing the gasoline in the area between oil retainer 28 and outer funnel portion 20 or by again directing the gasoline into interior 30 of oil retainer 28.

When the level in collection container C reaches a predetermined level, float 52 will float upon the mixed liquid level and raise rod 48. Since stopper 46 is connected thereto, stopper 46 is then removed from open end 34 of oil retainer 28 thus allowing discharge of the contents of oil retainer 28 through open end 34 of oil retainer 28 into interior 14 of outer funnel portion 12 for discharge through open end 18. Furthermore, enlarged end 55 of rod 48 also raises up and acts as a flag for visually indicating to the operator that the collection container C has reached the predetermined level and further liquid should not be added. It can then be appreciated that overflow of collection container C is thus prevented.

Stopper 46 may be manually raised from open end 34 of retainer 28 by grasping enlarged end 55 of rod 48 and by using end 55 as a handle, manually raising rod 48 allowing the liquid in oil retainer 28 to be discharged through discharge open end 34 into outer funnel portion 12 for discharge through open end 18. Further, according to the preferred embodiment of the present invention, stopper 46 can be held in a nonsealing relation with respect to open end 34 by the placement of retaining member 56 of rod 48 within hangers 58 of outer funnel portion 12. Therefore, any liquids poured into oil retainer 28 will then simply pass through open end 34 of oil retainer 28 into outer funnel portion 12 for discharge through open end 18.

It can then be appreciated that since the level of open end 32 of retainer 28 is below that of open end 16 of outer funnel portion 12, no spillage of liquid over outer funnel portion 12 occurs. Furthermore, it can then be appreciated that funnel 10 can be removed from the collection container at any time with no resulting spillage. Specifically, any liquid remaining in funnel 10 will be retained within oil retainer 28 since stopper 46 is located within open end 34 of oil retainer 28. Thus, funnel 10 is completely portable to any location whether liquid is located within oil retainer 28 or not.

Furthermore, the construction of self mixing funnel 10 according to the teachings of the present invention provides many advantages. First, all components of funnel 10 can be easily manufactured from inexpensive material, such as plastic. Additionally, since the oil is simply poured into oil retainer 28, there are no restrictions as to the type or variety of oils or other liquids to be utilized for mixing. Furthermore, oil retainer 28 constructed according to the teachings of the present invention accomodates the contents of all commercial oil containers commonly used for gasoline-oil mixing purposes.

Now that the basic teachings of the present invention have been explained, many extensions and variations will be obvious to one having ordinary skill in the art. For example, although outer funnel portion 12 and oil retainer 28 are symmetrical about rod 48 and is believed to be particularly advantageous, especially in providing a balanced weight distribution, other shapes, constructions, and types of funnel portions 12 and oil retainers 28 can be utilized according to the teachings of the present invention.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Self mixing funnel for mixing a first liquid with a second liquid comprising, in combination: an outer funnel portion having a first, enlarged filling open end, a second, reduced discharge open end, and an inside surface defining an interior; a liquid retainer having an enlarged filling open end, an outside surface, and an inside surface defining an interior, with the liquid retainer allowing discharge from the interior of the liquid retainer only by overflowing the filling open end of the liquid retainer, with the shape and size of the liquid retainer allowing the placement of the liquid retainer within the interior of the funnel portion, with the filling open end of the liquid retainer being smaller than the filling open end of the funnel portion; and means for suspending the liquid retainer within the interior of the outer funnel portion with the filling open end of the liquid retainer being below the filling open end of the funnel portion wherein the first liquid can be poured and retained within the interior of the liquid retainer and the second liquid can be poured into the interior of the liquid retainer for mixing with the first liquid and overflowing the filling open end of the liquid retainer into the interior of the funnel portion for discharge through the discharge open end of the funnel portion without overflowing the filling open end of the funnel portion; and wherein the suspending means comprises, in combination: webs extending between the inside surface of the funnel portion and the outside surface of the liquid retainer.

2. Self mixing funnel for mixing a first liquid with a second liquid comprising, in combination: an outer funnel portion having a first, enlarged filling open end, a second, reduced discharge open end, and an interior; a liquid retainer having a first, enlarged filling open end, a second, reduced discharge open end, and an interior; means for removably sealing the discharge open end of the liquid retainer, with the shape and size of the liquid retainer allowing the placement of the liquid retainer within the interior of the funnel portion, with the filling open end of the liquid retainer being smaller than the filling open end of the funnel portion; and means for suspending the liquid retainer within the interior of the outer funnel portion with the filling open end of the liquid retainer being below the filling open end of the funnel portion wherein the first liquid can be poured and retained within the interior of the liquid retainer and the second liquid can be poured into the interior of the liquid retainer for mixing with the first liquid and overflowing the filling open end of the liquid retainer into the interior of the funnel portion for discharge through the discharge open end of the funnel portion without overflowing the filling open end of the funnel portion.

3. The self mixing funnel of claim 2 further comprising, in combination: an elongated rod extending through the discharge open end of the funnel portion and the discharge open end of the liquid retainer, with the sealing means being mounted on the rod; and float means for floating on the mixed liquid in a collection container for removing the sealing means from the discharge open end of the liquid allowing the liquid in the liquid retainer to be discharged through the discharge open end of the liquid retainer into the interior of the funnel portion for discharge through the discharge open end of the funnel portion when the level in the collection container reaches a predetermined level.

4. The self mixing funnel of claim 3 wherein the elongated rod also extends through the filling open end of the funnel portion and the filling open end of the liquid retainer; and wherein the self mixing funnel further comprises, in combination: flag means for visually indicating when the level in the collection container reaches the predetermined level.

5. The self mixing funnel of claim 2 further comprising, in combination: an elongated rod extending through the filling open end of the funnel portion and the filling open end of the liquid retainer, with the sealing means being mounted on the rod; and handle means for manually raising the rod for removing the sealing means from the discharge open end of the liquid retainer allowing the liquid in the liquid retainer to be discharged through the discharge open end of the liquid retainer into the interior of the funnel portion for discharge through the discharge open end of the funnel portion.

6. The self mixing funnel of claim 5 further comprising, in combination: a retaining member formed on the rod intermediate the handle means and the sealing means; and hanger means for releaseably engaging with the retaining member for holding the rod in a raised position with the sealing means out of sealing engagement with the discharge open end of the liquid retainer allowing the liquid in the liquid retainer to be discharged through the discharge open end of the liquid retainer into the interior of the funnel portion for discharge through the discharge open end of the funnel portion.

7. The self mixing funnel of claim 1 further comprising, in combination: means located on the liquid retainer for visually determining the amount of liquid located in the liquid retainer.

8. Self mixing funnel for mixing a first liquid with a second liquid comprising, in combination: an outer funnel portion having a first, enlarged filling open end, a second, reduced discharge open end, and an interior;. a liquid retainer having an enlarged filling open end and an interior, with the liquid retainer allowing discharge from the interior of the liquid retainer only by overflowing the filling open end of the liquid retainer, with the shape and size of the liquid retainer allowing the placement of the liquid retainer within the interior of the funnel portion, with the filling open end of the liquid retainer being smaller than the filling open end of the funnel portion; and means for suspending the liquid retainer concentrically within the interior of the outer funnel portion with the filling open end of the liquid retainer being below the filling open end of the funnel portion wherein the first liquid can be poured and retained within the interior of the liquid retainer and the second liquid can be poured into the interior of the liquid retainer for mixing with the first liquid and overflowing the filling open end of the liquid retainer into the interior of the funnel portion around the entire diameter of the liquid retainer for discharge through the discharge open end of the funnel portion without overflowing the filling open end of the funnel portion; and wherein the liquid retainer includes a second, reduced discharge open end, and wherein the self mixing funnel further comprises, in combination: means for removably sealing the discharge open end of the liquid retainer.

9. The self mixing funnel of claim 6 further comprising, in combination: an elongated rod extending through the discharge open end of the funnel portion and the discharge open end of the liquid retainer, with the sealing means being mounted on the rod; and float means for floating on the mixed liquid in a collection container for removing the sealing means from the discharge open end of the liquid retainer allowing the liquid in the liquid retainer to be discharged through the discharge open end of the liquid retainer into the interior of the funnel portion for discharge through the discharge open end of the funnel portion when the level in the collection container reaches a predetermined level.

10. The self mixing funnel of claim 9 wherein the elongated rod also extends through the filling open end of the funnel portion and the filling open end of the liquid retainer; and wherein the self mixing funnel further comprises, in combination: flag means for visually indicating when the level in the collection container reaches the predetermined level.

11. The self mixing funnel of claim 8 further comprising, in combination: an elongated rod extending through the filling open end of the funnel portion and the filling open end of the liquid retainer, with the sealing means being mounted on the rod; and handle means for manually raising the rod for removing the sealing means from the discharge open end of the liquid retainer allowing the liquid in the liquid retainer to be discharged through the discharge open end of the liquid retainer into the interior of the funnel portion for discharge through the discharge open end of the funnel portion.

12. The self mixing funnel of claim 11 further comprising, in combination: a retaining member formed on the rod intermediate the handle means and the sealing means; and hanger means for releaseably engaging with the retaining member for holding the rod in a raised position with the sealing means out of sealing engagement with the discharge open end of the liquid retainer allowing the liquid in the liquid retainer to be discharged through the discharge open end of the liquid retainer into the interior of the funnel portion for discharge through the discharge open end of the funnel portion.

13. Self mixing funnel for mixing a first liquid with a second liquid comprising, in combination: an outer funnel portion having a first, enlarged filling open end, a second, reduced discharge open end, and an interior; a liquid retainer having an enlarged filling open end and an interior, with the liquid retainer allowing discharge from the interior of the liquid retainer only by overflowing the filling open end of the liquid retainer, with the shape and size of the liquid retainer allowing the placement of the liquid retainer within the interior of the funnel portion, with the filling open end of the liquid retainer being smaller than the filling open end of the funnel portion; and means for suspending the liquid retainer concentrically within the interior of the outer funnel portion with the filling end of the liquid retainer being below the filling open end of the funnel portion wherein the first liquid can be poured and retained within the interior of the liquid retainer and the second liquid can be poured into the interior of the liquid retainer for mixing with the first liquid and overflowing the filling open end of the liquid retainer into the interior of the funnel portion around the entire perimeter of the liquid retainer for discharge through the discharge open end of the funnel portion without overflowing the filling open end of the funnel portion; and wherein the outer funnel portion has an inside surface defining its interior and the liquid retainer has an outside surface and an inside surface defining its interior, and wherein the suspending means comprises, in combination: webs extending between the inside surface of the funnel portion and the outside surface of the liquid retainer.

14. Self mixing funnel for mixing a first liquid with a second liquid comprising, in combination: an outer funnel portion having a first, enlarged filling open end, a second, reduced discharge open end, and an interior; a liquid retainer having an enlarged filling open end and an interior, with the liquid retainer allowing discharge from the interior of the liquid retainer only by overflowing the filling open end of the liquid retainer, with the shape and size of the liquid retainer allowing the placement of the liquid retainer within the interior of the funnel portion, with the filling open end of the liquid retainer being smaller than the filling open end of the funnel portion; and means for suspending the liquid retainer concentrically within the interior of the outer funnel portion with the filling open end of the liquid retainer being below the filling open end of the funnel portion wherein the first liquid can be poured and retained within the interior of the liquid retainer and the second liquid can be poured into the interior of the liquid retainer for mixing with the first liquid and overflowing the filling open end of the liquid retainer into the interior of the funnel portion around the entire perimeter of the liquid retainer for discharge through the discharge open end of the funnel portion without overflowing the filling open end of the funnel portion; and further comprising, in combination: means located on the liquid retainer for visually determining the amount of liquid located in the liquid retainer.

* * * * *

UNITED STATES PATENT OFFICE

CERTIFICATE OF CORRECTION

Patent No. 4,549,585 Dated October 29, 1985

Inventor(s) Hartley T. Emerson

It is certified that error appears in the above-identified patent and that said Letters Patent are hereby corrected as shown below:

Column 6, lines 61 and 62, cancel "diameter" and substitute therefor --perimeter--.

Column 7, line 1, cancel "6" and substitute therefor --8--.

Signed and Sealed this

*Eighteenth* Day of *February 1986*

[SEAL]

*Attest:*

DONALD J. QUIGG

*Attesting Officer*

*Commissioner of Patents and Trademarks*